United States Patent [19]

Fukuda

[11] Patent Number: 4,580,656

[45] Date of Patent: Apr. 8, 1986

[54] ABSORBENT RETAINER FOR ABSORBENT TYPE MUFFLER

[75] Inventor: Masuo Fukuda, Omiya, Japan

[73] Assignee: Sankei Giken Kogyo Kabushiki Kaisha, Tokyo, Japan

[21] Appl. No.: 667,720

[22] Filed: Nov. 2, 1984

[30] Foreign Application Priority Data

Apr. 6, 1984 [JP] Japan ..... 59-69766
May 15, 1984 [JP] Japan ..... 59-97310

[51] Int. Cl.[4] ..... F01N 1/10
[52] U.S. Cl. ..... 181/252; 181/256; 181/265; 181/272
[58] Field of Search ..... 181/231, 244, 248–258, 181/264, 265, 268, 272, 275, 280; 55/276, DIG. 70

[56] References Cited

U.S. PATENT DOCUMENTS 3,166,382 1/1965 Purse et al. ..... 181/276 X
3,960,509 6/1976 Abriany ..... 55/276 X
4,360,076 11/1982 Suyama ..... 181/269 X
4,421,202 12/1983 Hoy ..... 181/244 X

*Primary Examiner*—Benjamin R. Fuller
*Attorney, Agent, or Firm*—Birch, Stewart, Kolasch & Birch

[57] ABSTRACT

A muffler connected to an exhaust system of an automotive or like internal combustion engine for damping noise, which accompanies engine exhaust, using a sound absorbing member. An intertwined meshwork in a tubular configuration serves as means for covering and firmly retaining the sound absorbing member, which is wound around a perforated pipe, on the outer periphery of the perforated pipe. The tubular meshwork is produced by intertwining in a desired density strings each of which is made up of a number of strands.

12 Claims, 7 Drawing Figures

ABSORBENT RETAINER FOR ABSORBENT TYPE MUFFLER

BACKGROUND OF THE INVENTION 1. Field of the Invention

The present invention relates to a muffler for damping the noise entailed by the emission of exhaust gases from an exhaust system of an internal combustion engine and, more particularly, to an improvement in a retainer for retaining a sound absorbing member in an absorbent type muffler. 2. Description of the Prior Art Mufflers heretofore proposed for the absorption of noise which accompany gases emanating from an exhaust system of an automotive or like internal combustion engine include one which uses a sound absorbing member, or absorbent. This type of muffler, generally referred to as an absorbent type muffler, comprises a pipe perforated with numerous holes for the passage of the gases, and a pipe larger in diameter than the perforated pipe and receiving the latter in its bore. The tubular space defined between the inner and outer pipes is filled with a permeable and heat resisting absorbent such as glass wool, rock wool, slag wool, and asbestos fibers. That is, an absorbent shaped in a mat having a predetermined thickness is wound around the outer periphery of the perforated or inner pipe or, alternatively, an absorbent baked after addition of heat resisting binder is inserted into the tubular space between the inner and outer pipes.

The problem encountered with a prior art absorbent type muffler having the above construction is that the absorbent filled in the tubular space is apt to be scattered in pieces while the muffler is in use, significantly deteriorating the function and durability of the muffler. Possible causes of such scattering of the absorbent are uneven packing of the absorbent due to machining errors, irregular density of the packed absorbent, play developed by vibration in the absorbent in the tubular space, i.e., the resulting clearance which would allow a gaseous stream flowing therethrough to entrain the absorbent, and high-velocity exhaust flows which separate the absorbent into pieces to entrain them while flowing through the absorbent. When two or more of such causes combine together, they contribute a great deal to the deterioration of the muffler.

SUMMARY OF THE INVENTION

It is therefore an object of the present invention to provide an improved absorbent retainer for an absorbent type muffler which may be associated with an exhaust system of any of various internal combustion engines.

It is another object of the present invention to provide an absorbent retainer for an absorbent type muffler which frees the muffler from deterioration in function and has remarkable durability.

It is another object of the present invention to provide an absorbent retainer for an absorbent type muffler which firmly retains a packed absorbent in a predetermined position.

It is another object of the present invention to provide an absorbent retainer for an absorbent type muffler which is simple in construction and, therefore, producible at low costs.

An absorbent type muffler which admits gases accompanied by noise thereinto for absorbing the noise of the present invention includes a perforated pipe for admitting and discharging the gases which is perforated with a number of holes in a predetermined portion of a wall thereof. A permeable tubular sound absorbing member is fit around the predetermined portion of the wall of the perforated pipe. The sound absorbing member causes the gases discharged from the holes of the perforated pipe to flow therethrough to absorb the noise. A tubular meshwork is provided for covering and retaining an outer periphery of the sound absorbing member with a predetermined pressure force. The gases passed through the sound absorbing member are discharged to the outside by way of the tubular meshwork.

In accordance with the present invention, a muffler is connected to an exhaust system of an automotive or like internal combustion engine for damping noise, which accompanies engine exhaust, using a sound absorbing member. An intertwined meshwork in a tubular configuration serves as means for covering and firmly retaining the sound absorbing member, which is wound around a perforated pipe, on the outer periphery of the perforated pipe. The tubular meshwork is produced by intertwining in a desired density strings each of which is made up of a number of strands.

BRIEF DESCRIPTION OF THE DRAWINGS

The objects and features of the present invention will become more apparent from a consideration of the following detailed description taken in conjunction with the accompanying drawings in which.

DESCRIPTION OF THE PREFERRED EMBODIMENTS

Figure 1:
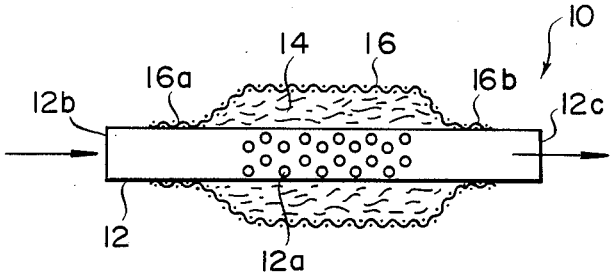
FIG. 1 is a vertical section of an absorbent type muffler to which an absorbent retainer of the present invention is applied.

Referring to FIG. 1 of the drawings, there is shown a basic construction of an absorbent type muffler 10 to which the present invention is applied. The muffler 10 comprises a perforated pipe 12 having numerous holes **12*a* formed therethrough, and an inlet 12*b* at one end for admitting gases emanating from an exhaust system of an automotive or like engine and an outlet 12*c* at the other end for discharging the gases. A sound absorbing member, or absorbent, 14 made of glass wool, rock wool, slag wool, asbestos fibers or any other suitable permeable material is wound around the perforated pipe 12. In accordance with the present invention, a unique tubular meshwork 16 is provided which firmly retains the absorbent 14 pressing it against the outer periphery of the perforated pipe 12**.

The tubular meshwork 16 is formed by intertwining steel wires, heat resisting strings, fiber glass long filaments or like strings in the configuration shown in FIG.

Figure 2A:
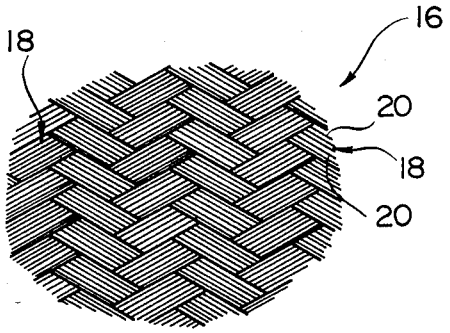
FIGS. 2A and 2B show different examples of a meshwork of the absorbent retainer in accordance with the present invention which is formed by intertwining numerous strings each consisting of strands.
Figure 2B:
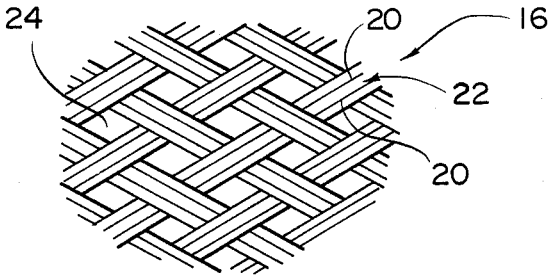

2A or 2B by way of example. In FIG. 2A, the meshwork 16 is made up of numerous strings 18 each consisting of numerous strands 20 and intertwined in a relatively high density. In FIG. 2B, the meshwork 16 is comprised of strings 22 each consisting of a relatively small number of strands 20; the strings 22 are interwined in a relatively low density to form relatively large meshes 24.

Figure 3:
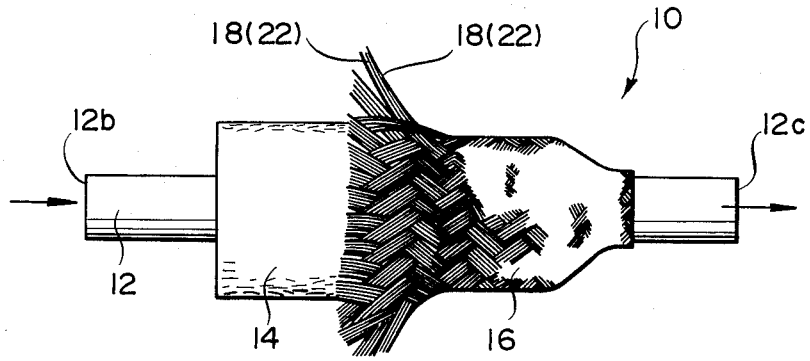
FIG. 3 shows a manner of attaching the meshwork of the present invention to an absorbent.

To attach the meshwork 16 to the absorbent 14 which is wound around the perforated pipe 12, it is fit over the absorbent 14 and, then, pulled along the axis of the pipe 12 while reducing the diameter of the absorbent 14. This keeps the absorbent 14 pressed sufficiently against the outer periphery of the pipe 12. Thereafter, opposite ends 16*a* and 16*b* of the meshwork 16 are squeezed to be welded, bonded or otherwise rigidly connected to the outer periphery of the pipe 12. Alternatively, as shown in FIG. 3, the meshwork 16 may be progressively formed while pressing the absorbent 14 against the pipe 12 with a predetermined pressure, that is, applying a squeezing force thereto.

As described above, in accordance with the present invention, the unique meshwork 16 serves to securely hold the absorbent 14 on the perforated pipe 12. Since the meshwork 16 itself is flexible in both the axial and circumferential directions, it exerts a constant magnitude of pressure force or squeezing force on the abosrbent 14 and, thereby, automatically absorbs any irregularity in the packing density of the absorbent 14 or undesirable clearance between the pipe 12 and the meshwork 16. This insures firm engagement of the absorbent 14 with the pipe so that the absorbent 14 is prevented from being scattered in pieces due to any of the aforementioned causes to deteriorate the function of the muffler or shorten its service life. As already discussed, a metal outer tube heretofore used as an absorbent retainer is naturally unchangeable in shape or volume, that is, the volume of the tubular clearance between a perforated pipe with an absorbent mounted therearound and the metal outer tube is unchangeable. The metal outer tube, therefore, cannot absorb undesirable clearance which may develop when the absorbent is stressed by some cause to become uneven in density.

Figure 4:
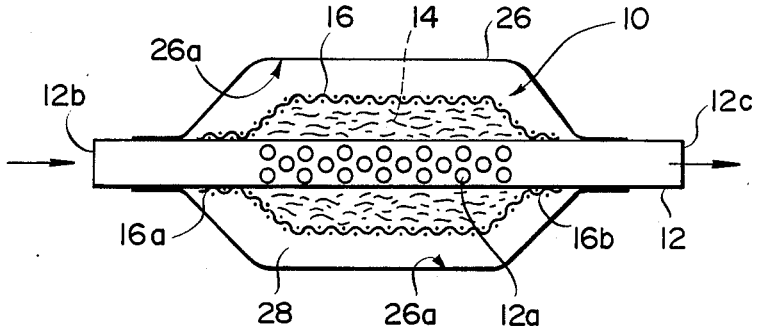
FIG. 4 is a vertical section of a modification to the arrangement of FIG. 1 in which the muffler is enclosed in a shell.

As described above, the absorbent type muffler 10 shown in FIG. 1 damps noise to a satisfactory extent even when used alone. If desired, as shown in FIG. 4, the muffler 10 may be bodily enclosed in a tubular shell 26 which has a large bore thereinside. Naturally, the shell 26 is not directed to holding the absorbent 14 on the perforated pipe 12. The shell 26 functions such that the noise accompanying the gaseous stream passed through the absorbent 14 is reflected by the inner wall 26*a* of the shell 26 to be damped thereby. Therefore, the clearance 28 between the shell inner wall 26*a* and the meshwork 14 is so dimensioned as to attain the best muffling effect.

Figure 5:
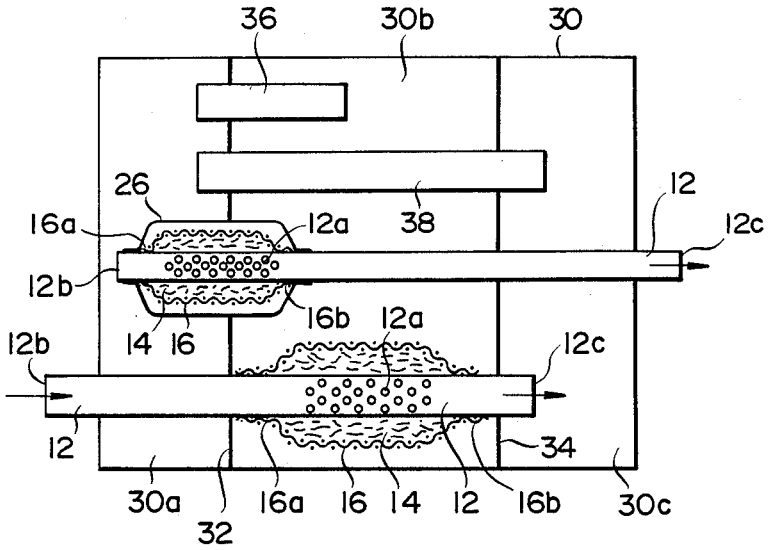
FIG. 5 is a vertical section of an embodiment of the present invention in which the muffler shown in FIG. 4 is combined with another type of muffler.

Referring to FIG. 5, there is shown an exemplary application of the muffler 10 shown in FIG. 1 and the muffler 10 shown in FIG. 2, which is disposed in the shell 26. As shown, the mufflers 10 are mounted in a housing 30 which has three chambers 30*a*, 30*b* and 30*c* defined by partitions 32 and 34. The chambers 30*a* and 30*b* are intercommunicated by a pipe 36, while the chambers 30*a* and 30*c* are intercommunicated by a pipe 38. In this manner, a muffler with a unique absorbent retainer of the present invention may be combined with any of various known types of mufflers such as a pipe insertion type, resonance type and interference type, with a view to attaining their functions at the same time.

Figure 6:
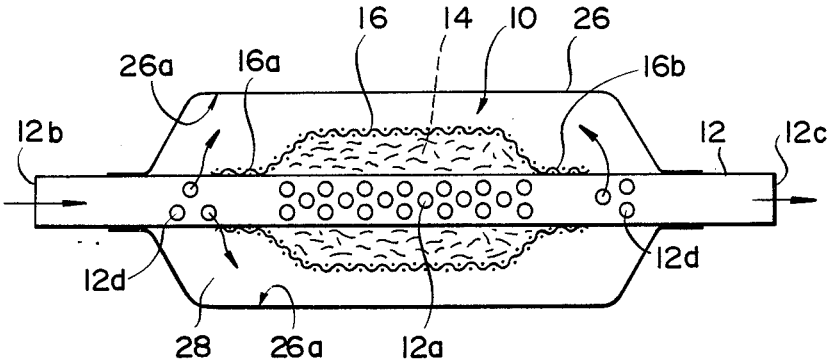
FIG. 6 is a vertical section of still another modification to the muffler of FIG. 4.

A modification to the muffler construction shown in FIG. 4 is shown in FIG. 6. In the modified muffler, the perforated pipe 12 inside the shell 26 is formed with a plurality of holes 12*d* in its part uncovered by the absorbent 14 as well as the covered part. In this construction, the gaseous stream flowing through the perforated pipe 12 will be partly discharged to the space 28 via the holes 12*d* without the intermediary of the absorbent 14. The noise thus introduced directly into the space 28 via the holes 12*d* is reflected by the inner wall 26*a* of the shell 26 to further enhance noise reduction, aided by interference or resonance. The muffler shown in FIG. 6, like the muffler shown in FIG. 5, may be used in combination with any of known types of mufflers for achieving two or more different functions at a time.

What is claimed is:

1. An absorbent type muffler which admits gases accompanied by noise thereinto for absorbing the noise, comprising:

(a) a pipe for admitting and discharging the gases which is perforated with a number of holes in a predetermined portion of a wall thereof;

(b) a permeable tubular sound absorbing member fit around said predetermined portion of the wall of said perforated pipe, said sound absorbing member causing the gases discharged from the holes of the pipe to flow therethrough to absorb the noise; and (c) a tubular meshwork for covering and retaining an outer periphery of said sound absorbing member with a predetermined pressure force, said tubular meshwork having opposite end portions generally tapered to be rigidly connected to the wall of the perforated pipe so as to produce the predetermined pressure force whereby scattering of the absorbent material is prevented and the gases passing through the sound absorbing member are discharged to the atmosphere by said tubular meshwork.

2. An absorbent type muffler in accordance with claim 1, wherein the tubular meshwork is formed by intertwining strings each comprising a predetermined number of strands.

3. An absorbent type muffler in accordance with claim 2, wherein the strings are intertwined in a high density to form small meshes.

4. An absorbent type muffler in accordance with claim 2, wherein the strings are intertwined in a low density to form large meshes.

5. An absorbent type muffler in accordance with claim 2, wherein the strings comprise at least one of steel wires, heat resisting strings, and fiber glass long filaments.

6. An absorbent type muffler which admits gases accompanied by noise thereinto for absorbing the noise, comprising:

(a) a pipe for admitting and discharging the gases which is perforated with a number of apertures in a predetermined portion of a wall thereof;

(b) a permeable tubular sound absorbing member fit around said predetermined portion of the wall of said perforated pipe, said sound absorbing member causing the gases discharged from the holes of the pipe to flow therethrough to absorb the noise;

(c) a tubular meshwork for covering and retaining an outer periphery of said sound absorbing member with a predetermined pressure force, said tubular meshwork having opposite end portions generally tapered to be rigidly connected to the wall of the perforated pipe so as to produce the predetermined pressure force whereby scattering of the absorbent material is prevented and the gases passing through the sound absorbing member are discharged by the tubular meshwork; and (d) a housing member formed with a bore having a predetermined volume which encapsulates the sound absorbing member and the tubular meshwork, whereby the noise accompanying the gases passed through the meshwork are reflected by an inner wall of said housing.

7. An absorbent type muffler in accordance with claim 6, wherein the perforated pipe is formed with other apertures in a portion thereof other than said predetermined portion, said other aperatures communicating to the bore of the housing and not being covered with said tubular meshwork.

8. An absorbent type muffler in accordance with claim 7, wherein the perforated pipe has an inlet for admitting the gases and an outlet for discharging the gases, said other apertures being formed adjacent to at least one of said inlet and said outlet.

9. An absorbent type muffler in accordance with claim 6, wherein the tubular meshwork is formed by intertwining strings each comprising a predetermined number of strands.

10. An absorbent type muffler in accordance with claim 11, wherein the strings are intertwined in a high density to form small meshes.

11. An absorbent type muffler in accordance with claim 11, wherein the strings are intertwined in a low density to form large meshes.

12. An absorbent type muffler in accordance with claim 11, wherein the strings comprise at least one of steel wires, heat resisting strings, and fiber glass long filaments.

* * * * *